United States Patent [19]

Dubach

[11] 4,359,166

[45] Nov. 16, 1982

[54] CONTAINER CLOSURE CAP

[75] Inventor: Werner F. Dubach, Maur, Switzerland

[73] Assignee: Createchnic Patent AG, Dietlikon, Switzerland

[21] Appl. No.: 200,202

[22] Filed: Oct. 24, 1980

[30] Foreign Application Priority Data

Nov. 7, 1979 [CH] Switzerland ..... 9961/79

[51] Int. Cl.[3] ..... B65D 45/32

[52] U.S. Cl. ..... 215/272

[58] Field of Search ..... 215/272; 220/319, 320; 292/265.5; 24/256, 257; 285/322

[56] References Cited

U.S. PATENT DOCUMENTS

| | | | |
|---|---|---|---|
| 1,545,227 | 7/1925 | Baltzley | 215/272 |
| 2,814,405 | 11/1957 | Edwards | 215/272 X |
| 4,248,459 | 2/1981 | Pate et al. | 285/322 X |
| 4,251,003 | 2/1981 | Bodenmann | 215/272 X |
| 4,279,353 | 7/1981 | Honma | 215/272 X |

FOREIGN PATENT DOCUMENTS

| | | | |
|---|---|---|---|
| 1442433 | 7/1976 | United Kingdom | 215/272 |

*Primary Examiner*—Donald F. Norton

*Attorney, Agent, or Firm*—Werner W. Kleeman

[57] ABSTRACT

A closure device for a bottle or the like wherein the closure device which, in its closed condition, comprises a pressure ring and a claw cap is fabricated of one-piece in that the pressure ring is connected with the claw cap by means of webs which are disposed between its engagement portions and the roof wall of the claw cap. By pressing the pressure ring downwardly over arms and claws of the closure cap, while tearing the webs, the claws are pressed against the underside of a mouth bead of the neck of the bottle and are pressed into a constricted portion of the bottle neck. By rotating the pressure ring such that its engagement portions or parts depart from the U-shaped claws and by lifting the same it is possible to remove the closure cap from the dispensing or pour opening of the bottle neck, since the engagement parts upwardly raise the claw cap at a lower edge of the roof wall of such claw cap.

8 Claims, 3 Drawing Figures

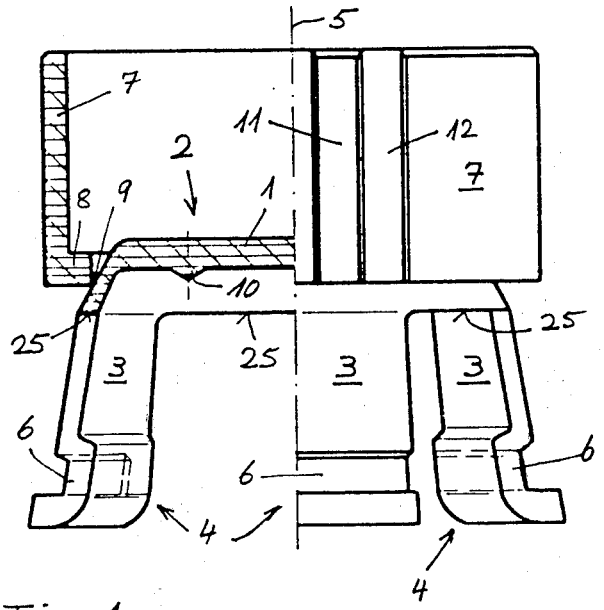
Fig. 1
Fig. 2
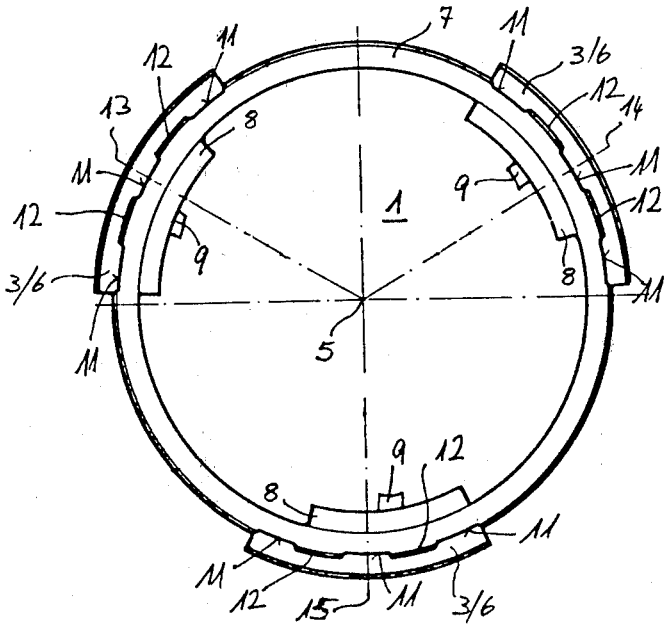

CONTAINER CLOSURE CAP

BACKGROUND OF THE INVENTION

The present invention relates to a new and improved construction of a closure device for a bottle or the like and a method of manufacturing the same.

Generally speaking, the closure device of the present invention is in the form of a closure cap which serves to close a bottle or similar containers or receptacles having a neck provided with a dispensing or pour opening, a neck end surface surrounding the dispensing opening and a mouth bead located below the neck end surface and having at its underside a constricted portion. The closure cap possesses a claw cap which comes to lie above the dispensing opening and covers the same at least at its outer region. The claw cap is provided with a roof or ceiling wall which continues in the form of a number of arms past the mouth bead and has claws which come to lie in the constricted portion. The claw cap carries a pressure ring which, in the closed position of the closure cap upon the bottle, fixedly presses the arms and claws against the mouth bead in such a manner that the closure cap is fixedly connected with the mouth bead of the bottle.

In order to close the most different types of bottles or flasks, extending from ampule bottles to beer bottles and up to salad oil bottles fabricated from plastic materials, there are required positive closure devices of the above-described type.

There are already known to the art such type of closure devices, for instance from U.S. Pat. No. 2,671,572 of William Satz, granted Mar. 9, 1954. Also in German Patent Publication No. 2,210,414 of Albert Obrist & Co. and German Patent Publication No. 2,319,617 of Jean Grussen, there have been disclosed bottle closures provided with ring elements, which can be pivotably attached to a cap and are connected at the cap circumference by means of small tear webs with the cap prior to the initial opening of the bottle. The undamaged webs only indicate that there has not yet occurred any opening of the filled bottle. The ring element, following the tearing of the webs, serves as a grip ring for the decapping of the bottle and for the removal of the cap during each further opening of the bottle. However, none of both of the last-mentioned ring elements contributes to the improved attachment of the cap at the flask or bottle mouth while encountering the internal pressure within the bottle. The bottle closure described in U.S. Pat. No. 3,825,144 of Walter Wiedmer is either sprung off the bottle when encountering even the most relatively slight pressure increase within the bottle, or it is too stiff and therefore is seated much too rigidly in order to be easily opened with the finger of a hand of the user.

In contrast to these ring elements the ring element provided in the aforementioned U.S. Pat. No. 2,671,572 of William Satz plays a decisive role during the sealing closing operation. Yet, such ring element is associated with certain drawbacks. It should not be too elastic in order that it is capable of sealingly pressing the slotted lateral cap wall satisfactorily against the mouth bead. Additionally, at the lifting side there does not prevail any contact between the ring element and the lateral cap wall over a region corresponding to an arc of about 40 degrees. To ensure that there is accomplished a uniform pressing of the lateral cap wall against the remaining circumferential region of about 320 degrees, it is necessary that the ring element be constructed to be relatively rigid, and therefore it acts upon the lateral cap wall more in the manner of exerting a retention action than a pressing together action, i.e. the lower end region of the tongues are passively prevented from spreading apart by the underside of the mouth bead of the bottle when there prevails an increased pressure internally of the bottle, for instance due to a temperature increase or shaking or jarring of the bottle, but however these tongues are not actively pressed against the underside of the mouth bead. If the latter occurs then the pressure exterted by the ring element upon the lateral cap wall must be so strongly dimensioned that there is rendered more difficult lifting-off of the ring element for the purpose of opening the bottle.

Yet, all of the heretofore known closure elements possess relatively decisive drawbacks, whether such be that they only can be used to a limited degree, or that they consist of a number of individual parts which must be properly positioned in order to assemble the closure element.

SUMMARY OF THE INVENTION

Therefore, with the foregoing in mind it is a primary object of the present invention to provide a new and improved construction of a closure device and method of manufacturing the same, which is not associated with the aforementioned drawbacks and limitations of the prior art proposals.

Another and more specific object of the present invention aims at providing a new and improved construction of a closure device, typically in the form of a closure cap of the previously described type, which can be molded of one-piece in a conventional plastic material and can be automatically mounted and without the need for any specific positioning operations upon the bottle neck of the bottle which is to be closed, and wherein such closure cap can again be removed by rotating and lifting the pressure ring.

Another object of the invention aims at constructing such closure cap such that after it has been placed into use it can either be used only for single closing of the bottle or, however, can be repeatedly reused for closing of the bottle.

Still a further significant object of the invention aims at providing a new and improved construction of closure cap which is provided in a most simple manner with an opening seal which is destroyed during the initial opening of the bottle.

Yet a further significant object of the present invention aims at providing a new and improved construction of closure cap wherein a bottle opening can be sealingly closed either by means of a separate stopper or directly.

Now in order to implement these and still further objects of the invention, which will become more readily apparent as the description proceeds, the closure cap of the present development is manifested by the features that prior to mounting the closure cap upon the neck of a bottle or the like the pressure ring is connected in one-piece with engagement portions, located at its lower inner circumference, by means of webs with the roof wall of the claw cap, and the engagement portions, with the closure cap mounted upon the bottle neck, firmly press the claws into the constricted portion at the underside of the mouth bead.

According to an advantageous construction of the invention the pressure ring possesses the same number of engagement portions as the closure cap has arms and claws, and with the one-piece closure cap in its unmounted state such engagement portions, when viewed from above, are located upon the same radius of a circle as such arms and claws.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a fragmentary longitudinal sectional view through a closure cap which has not yet been mounted upon a bottle or the like which is to be closed and with the closure cap shown still formed of one-piece;

FIG. 2 is a top plan view of the closure cap of FIG. 1; and

DETAILED DESCRIPTION OF THE PREFERRED EMBODIMENTS

Figure 3:
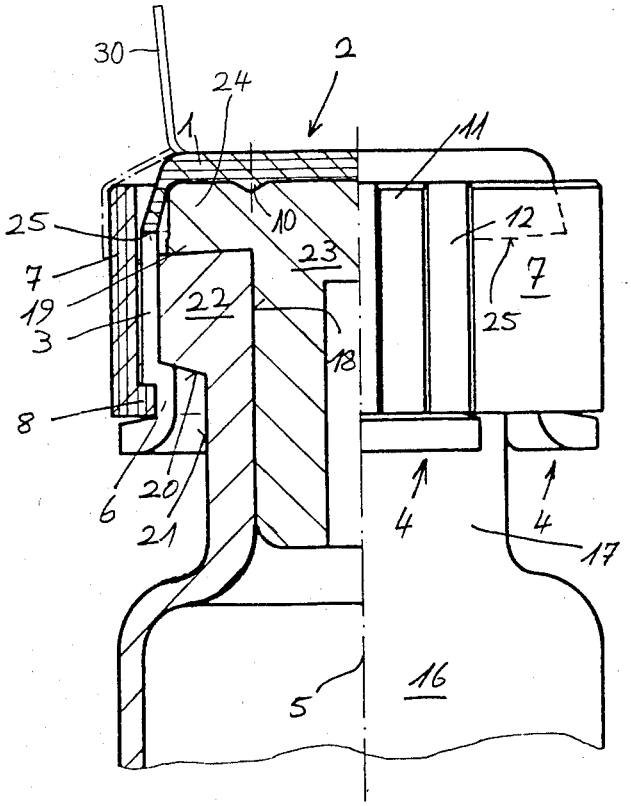
FIG. 3 is a fragmentary longitudinal sectional view through a closure cap as shown in FIG. 1 and mounted upon an ampule flask.

Describing now the drawings, in FIG. 1 there is illustrated a possible construction of a closure device, in the form of a closure cap, according to the invention. This closure cap will be seen to comprise a continuous roof or ceiling wall 1 of a claw cap 2 having three arms or arm members 3 extending downwardly from the ceiling wall 1. Further, there will be recognized that the arm members 3 possess at their lower end or terminal regions 4 towards the center, in other words in the direction of the central axis 5 of the closure cap, substantially U-shaped claws 6 or equivalent structure, the function of which will be discussed more fully hereinafter in conjunction with FIG. 3. Additionally, there will be recognized that a pressure or press-over ring 7 is connected in one-piece by means of tearable webs 9 with the ceiling or roof wall 9. The pressure ring 7 is provided at its lower inner circumference with engagement portions or parts 8. In the illustrated embodiment of inventive closure cap the roof or ceiling wall 1 is provided at its underside with protuberances or dogs 10 which, as will be explained more fully hereinafter in conjunction with FIG. 3, protect the closure cap against rotation. To increase the gripability of the pressure ring 7 the latter can be provided with grooves 11 and ribs 12.

It will be readily apparent to one skilled in the art that the closure cap illustrated in FIG. 1, which essentially consists of the claw cap 2 and the pressure ring 7, can be molded in one-piece or integrally.

FIG. 2 illustrates a top plan view of the inventive closure cap of FIG. 1 and shows, in particular, the features that the arms 3 along with their claws 6 are uniformly distributed about the circumference of the roof wall 1 and are located upon the same circular arcs or radii 13, 14, 15 as the engagement portions 8 which connect the pressure ring 7 by means of the webs 9 with the claw cap 2.

FIG. 3 illustrates the manner in which the inventive closure cap can be secured to an ampule flask or bottle 16 having a bottle neck 17 and a dispensing or pour opening 18. The bottle or flask 16 further has a neck end surface 19 which surrounds the dispensing or pour opening 18 and a mouth bead 22 located below the neck end surface 19 and possessing at its underside 20 a constricted portion or constriction 21. In the arrangement shown the ampule flask or bottle 16 has been closed by means of a stopper 23 upon which there is seated the closure cap of the invention.

By pressing down the pressure ring 7, resulting in tearing of the webs 9 (FIGS. 1 and 2), this pressure ring 7 is, first of all, snugly placed about the arm members or arms 3, which thus bear against the mouth bead 22 of the bottle or flask 16 or the like and, on the other hand, the engagement portions 8 are placed into the substantially U-shaped claws 6 which are thus firmly pressed against the underside 20 and into the constriction or constricted portion 21. In this way there is achieved the result that with appropriate configuration of the arms 3 and claws 6, in accordance with the bottle neck 17 and its mouth bead 22, and while taking into account the thickness and elasticity of the cover 24 of the stopper or plug 23, this stopper 23 is firmly and sealingly retained in the neck 17 of the bottle 16. The now two-piece closure cap, consisting of the claw cap 2 and the pressure ring 7 which radially surrounds such claw cap 2, is secured against any rotation and detachment from the bottle 16. The protuberances or cams 10 which penetrate into the stopper 23 appreciably contribute to safegarding against rotation of the closure cap. Due to the configuration of the engagement portions or elements 8 and the dimensioning of the pressure ring 7, but also because of the constructional design of the claws 6, especially as a function of the shape of the engagement portions 8 and the mouth bead 22, it is possible in conjunction with a careful selection of the plastics material used for fabricating the closure cap to non-displacably mount such upon practically any bottle neck 17 having a mouth bead 22.

Opening of the inventive closure cap, as the same has been shown in the drawings and heretofore described, is extremely simple, notwithstanding the fact that it is fixedly mounted upon the bottle neck 17, and only requires a relatively modest expenditure in force. By rotating the pressure ring 7 about the central axis 5 the engagement portions or elements 8 are turned out of the U-shaped claws 6 and such are freed to a limited degree. As a result, however, also the ring member or pressure ring 7, and, in particular, its engagement portions 8 are freed to a limited degree in axial direction upwards. It is not possible to downwardly displace the pressure ring 7 due to the claws 6. On the other hand, such pressure ring 7 can be pulled upwardly, practically without any resistance, to such a degree until the engagement portions 8 impact against the lower edge 25 of the downwardly drawn roof wall 1. Due to further lifting of the pressure ring 7 it is thus possible to also remove the claw cap 2 from the bottle neck 17 and its mouth bead 22, respectively. The bottle or flask 16 is then only still closed by means of the stopper or plug 23.

From the above description of the opening operation of the inventive closure cap it will be recognized that the free spaces of the roof wall circumference and which free spaces are present between two neighboring arms 3 and claws 6 must be at least so large in size as corresponds to the width of the engagement portions 8, in order to obtain a complete release of the claws 6 during rotation of the pressure ring 7.

It will be readily recognized from the illustrated and heretofore described exemplary embodiment of inventive closure cap that such closure cap is only suitable for a one-time closing of the bottle or flask 16 and requires a stopper or plug 23 or equivalent structure for sealing such bottle. It does not come into contact with the contents stored in the bottle 16. Additionally, the inventive closure cap can effectively prevent any unauthorized opening and reclosing of the bottle 16 if it is provided with a seal formed as a web and formed, for instance, by induction welding, between the pressed-in pressure ring 7 and the roof wall 1, and the seal webs can be automatically broken by rotating the pressure ring 7 in relation to the roof wall 1. Such sealing webs can be directly molded in the form of an upright tab 30, for instance at the upper edge of the roof wall 1 and upon depressing the pressure ring 7 bear against the same and are welded thereto.

It should of course be clearly understood that the invention is not limited to the described and illustrated exemplary embodiment, and specifically, by way of example and not limitation, the closure cap also can be designed as a sealing bottle or flask closure by means of an upset or inverted seal which is molded at the underside of the roof or ceiling wall 1. Furthermore, the arm members 3 can be provided at the region where they merge into the roof wall 1 with sawtooth-shaped circumferentially extending grooves into which there again can be rotated back the engagement portions 8 of the pressure ring 7 after the closure cap has been opened in the manner described above. This enables repeatedly using the closure cap in that the turned-back pressure ring 7 only again must be downwardly pressed in order to bring the closure cap back into its closed position.

Depending upon the field of application of the inventive closure cap such can be provided with a roof wall 1 having a central opening. In this way it is possible for the closure cap to also be used, for instance, for the connection of tubes with closure flanges.

Furthermore, it is readily possible to increase the number of arm members 3 and claws 6 of the claw cap 2 as well as to correspondingly increase the number of engagement portions 8 of the pressure ring 7. Equally, the closure cap can have a shape different than a circular shape.

Finally, it is here mentioned that additional modifications and deviations from the described exemplary embodiment of the inventive closure cap will readily suggest themselves to those skilled in the art without departing from the underlying teachings and principles of the invention, particularly as concerns accommodation of the arms or arm members 3 and the claws 6 to given but differently constructed bottle or container dispensing or pour openings 18 and necks 17, or the claw cap 2 as well as the pressure ring 7 must be accommodated to special fields of use and requirements.

While there are shown and described present preferred embodiments of the invention, it is to be distinctly understood that the invention is not limited thereto, but may be otherwise variously embodied and practiced within the scope of the following claims. Accordingly,

What I claim is:

1. A closure cap adapted for closing a bottle or similar container having a neck and a dispensing opening, a neck end surface surrounding the dispensing opening and a mouth bead located below the neck end surface and a constricted portion at its underside, comprising:

a claw cap intended to lie above the dispensing opening of the bottle and adapted to cover such bottle dispensing opening at least at its outer region;

said claw cap having a roof wall;

said roof wall being provided with a number of arm members adapted to extend past the mouth bead;

said arm members being provided with claws which are adapted to lie in the constricted portion of the bottle;

a ring member supported by said claw cap and having engagement portions;

said ring member, in a closed position of the closure cap when seated upon the bottle, pressing the arm members and claws firmly against the mouth bead such that the closure cap is firmly connected with the mouth bead;

said ring member being connected in one-piece with the roof wall of the claw cap by means of webs at said engagement portions which are located below an inner circumference of said ring member;

said engagement portions, with the closure cap mounted upon the bottle neck, being adapted to firmly press the claws into said constricted portion at an underside of the mouth bead;

said ring member possesses the same number of engagement portions as the closure cap possesses arm members and claws;

said engagement portions, in the unmounted condition of the closure cap when it is still in one-piece and when viewed from above, being arranged on the same respective radius of a circle as the related arm member and claw; and said arm members and claws of the claw cap and said engagement portions of the ring member are uniformly distributed over the circumference of the closure cap and form therebetween free spaces which have a length at least as long as the engagement portions are wide.

2. The closure cap as defined in claim 1, wherein:

said claws comprise substantially U-shaped end portions of the arm members and which extend towards a central axis of the closure cap.

3. The closure cap as defined in claim 1, wherein:

said roof wall of the claw cap extends downwardly between said arm members.

4. The closure cap as defined in claim 1, wherein:

said engagement portions and the claws are structured such that the engagement portions can be nondisplaceably latched into the claws in axial direction thereof.

5. The closure cap as defined in claim 1, wherein:

said roof wall is provided with an underface carrying protuberance means.

6. The closure cap as defined in claim 1, wherein:

said roof wall has an underface provided with rubber stopper means.

7. The closure cap as defined in claim 1, wherein:

said ring member is provided at least at predetermined locations thereof with vertical groove means and rib means.

8. The closure cap as defined in claim 1, wherein:

said roof wall has an upper surface;

said upper surface of said roof wall being provided at the region of its greatest circumference with at least one upwardly substantially vertically extending tab means which can be welded as a seal to an upper edge of the member ring.

* * * * *